United States Patent [19]

Blytas et al.

[11] Patent Number: 4,705,530

[45] Date of Patent: Nov. 10, 1987

[54] REDUCTION OF SODIUM IN COAL BY WATER WASH AND ION EXCHANGE WITH A WEAK ELECTROLYTE

[75] Inventors: George C. Blytas; Frank J. Trogus, both of Houston, Tex.

[73] Assignee: Shell Oil Company, Houston, Tex.

[21] Appl. No.: 22,474

[22] Filed: Mar. 6, 1987

Related U.S. Application Data

[63] Continuation of Ser. No. 779,718, Sep. 24, 1985, abandoned.

[51] Int. Cl.[4] ..... C10L 9/02

[52] U.S. Cl. ..... 44/1 R; 423/461

[58] Field of Search ..... 44/1 R, 1 SR; 201/17; 423/461

[56] References Cited

U.S. PATENT DOCUMENTS

| | | | |
|---|---|---|---|
| 618,104 | 1/1899 | Kenevel | 201/17 |
| 3,454,363 | 7/1969 | Rieve | 201/17 |
| 3,993,456 | 11/1976 | Cole et al. | 44/1 SR |
| 3,998,604 | 12/1976 | Hinkley | 44/1 R |
| 4,400,176 | 8/1983 | Kutta | 44/1 R |
| 4,522,628 | 6/1985 | Javins | 44/1 SR |

*Primary Examiner*—Carl F. Dees

*Attorney, Agent, or Firm*—H. W. Coryell; D. Y. Wolfs

[57] ABSTRACT

Coal can be freed of ion-exchangeable sodium by contacting it with aqueous solutions of $CO_2$ or formic or acetic acids at a mine mouth or contacting it with aqueous $CO_2$ while transporting it in a pipeline.

5 Claims, No Drawings

REDUCTION OF SODIUM IN COAL BY WATER WASH AND ION EXCHANGE WITH A WEAK ELECTROLYTE

This is a continuation of application Ser. No. 779,718, filed Sept. 24, 1985, now abandoned.

RELATED APPLICATIONS

The present application is related to the commonly assigned and concurrently filed applications Ser. Nos. 779,716 and 779,717 on "Selective Reduction of Sodium in Coal by Water Wash and Ion Exchange With Tailored Electrolyte" and "Reduction of Sodium in Coal by Water Wash Followed by Ion Exchange Within A Pipeline." The disclosures of the related applications are incorporated herein by reference.

BACKGROUND OF THE INVENTION

The present invention relates to upgrading coal by removing sodium ions. More particularly, the invention relates to removing sodium ions from coal by means of water-washing and ion-exchange.

The presence of large amounts of sodium in coal is undesirable as it contributes to fouling of combustion facilities. The fouling problems can arise if sodium exceeds about 3%w (as $Na_2O$), yet several important deposits of coal contain more than that much sodium. Thus, a process which can economically remove, for example, 30 to 50 percent of the sodium, can be very desirable and can be a prerequisite condition for exploitation of sizeable deposits.

The levels of sodium oxide in the ash at which coal combustion can lead to fouling problems are not yet clearly defined, and can be different for different coals. Nevertheless, levels in excess of about 3%w are not desirable and coals with more than 4%w in the ash, are generally difficult to market. Some Powder River Basin coal samples have been found to yield over 6%w of sodium oxide.

SUMMARY OF THE INVENTION

The present invention relates to upgrading coal. This coal is first contacted with a relatively ion-free water in order to dissolve significant proportions of water-soluble sodium compounds. The water washed coal is then contacted with a relatively sodium-free aqueous solution of a weak acid, in order to ion-exchange a significant proportion of sodium ions from the coal for protons from the acid solution.

DESCRIPTION OF THE INVENTION

We have found that sodium may occur in coals in three forms; (a) water-soluble sodium, (b) ion-exchangeable sodium, and (c) fixed sodium. The ion-exchangeable sodium can be about 30 to 80 percent of the total, with the balance being split between water-soluble and fixed sodium. Many low-rank coals can be rendered marketable and useable by the present process, which is often capable of removing 30 to 50 percent of the sodium ions (measured as $Na_2O$) economically.

The sample tested was from the Powder River Basin and was ground into three fractions as follows:

(A) ¾" by 28 mesh (B) Less than 14 mesh (C) Less than 28 mesh

Sample fractions (B) and (C) were dried to 8–9%w water (down from ~25%) by heating in a vacuum at 100° C. Analysis of sample fractions (B) and (C) has yielded $Na^+$ $Mg^{++}$ and $Ca^{++}$ contents and ash levels which were less than 3% apart. Accordingly, for the metals removal calculations, we have used the average of analyses obtained on sample fractions (B) and (C).

We can consider the coal sample as an ion-exchanger in which negative fixed sites (believed to be $R—COO^-$ or similar moieties) are counterbalanced primarily by $Na^+$, $Ca^{++}$ and $Mg^{++}$ cations. Relatively minor amounts of $K^+$ ions are also present, but will be neglected. The form in which iron occurs has not been determined, although it is expected to be primarily as pyrite. In Table 1, along with the analysis of $Na^+$, $Ca^{++}$ and $Mg^{++}$, we show the percentage present as a portion of total exchangeable cations.

TABLE 1

Metal and Ash Contents in the Coal Tested

| | Fraction | | | Equivalent Base |
|---|---|---|---|---|
| | 14–28 Mesh | <28 Mesh | Average | Capacity % |
| Sodium (ppm) | 2370 | 2430 | 2400 | 17 |
| Calcium (ppm) | 7570 | 7800 | 7685 | 64 |
| Magnesium (ppm) | 1330 | 13700 | 1350 | 19 |
| Ash % w | 4.79 | 4.77 | 4.78 | — |

Contact times from a few hours to several days were studied, the former corresponding to mine-mouth conditions, the latter corresponding to pipeline transport conditions. Coal particle sizes and solid/liquid ratios were selected accordingly.

The degree of sodium, calcium and magnesium reduction in coal, resulting from various ion-exchange treatments, was estimated by monitoring the increase in the level of these ions in the treating solution. In general, $Na^+$ analysis was done by ion-specific electrode methods, whereas $Ca^{++}$ and $Mg^{++}$ analysis was done by titration methods.

In the present tests, weak electrolytes were studied using generally low solid/liquid ratios 1.5/1 and 2/1 and long residence times, of several days. These experiments were designed to simulate pipeline transport reaction conditions.

The $CO_2/H_2O$ system was tested both at low pressures and at high pressures. The low pressure system was conveniently obtained by saturating an aqueous phase with dry ice. The resulting solution, at a pH of about 5, was quickly neutralized when placed in contact with coal. Additional saturation with dry ice, or bubbling $CO_2$, was used to maintain the pH to 5.6–5.8 so that cation exchange would occur.

The high pressure $CO_2$ systems were studied in closed pressurized vessels. An overpressure of $CO_2$ was applied, and a coal/water slurry was isolated and allowed to interact with the dissolved $CO_2$. Typically, an overpressure of 300 psi $CO_2$ was maintained. These pressure ranges fall within those anticipated for pipeline transport.

Low liquid-to-solid ratios were studied, with −14 mesh coal samples, and up to 10 days of contact time. These correspond to pipeline transport conditions.

Some results obtained with atmospheric $CO_2$ and high pressure $CO_2$ treatments are summarized in Table 2. The pH in the low pressure runs was adjusted to 5.6 after three days and after six days of contact. The pH of the high pressure runs was not determined but an overpressure of 300 psi was re-established after three days and after six days.

TABLE 2

Sodium Reduction with $CO_2H_2O$ Systems

| Liquid/Solid | $CO_2$ Source | % Sodium Removal 3 Days | % Sodium Removal 10 Days |
|---|---|---|---|
| 1.5 | Dry Ice[a] | 21 | 27 |
| 2 | Dry Ice | 23 | 31 |
| 4 | Dry Ice | 41 | 45 |
| 2 | High $CO_2$ Pressure[b] | 40 | 44 |

[a]pH readjusted to 5.6 after 3 and 6 days
[b]high $CO_2$ pressure readjusted to 300 psi at 3 and 6 days From the results shown in Table 2, it appears that a low pressure $CO_2$ treatment could be effective if utilized with higher liquid/solid ratios, i.e. under mine-mouth conditions. Thus, if a marginal sodium reduction is adequate, and if an inexpensive source of $CO_2$ is available, we would increase the extent of sodium removal achieved by water-wash (e.g. amounting to 40 to 45 percent removal of sodium) by bubbling $CO_2$ through the washing unit. Essentially, this would result in adding an ion-exchange capability to at least a portion of the water-wash.

The high $CO_2$ pressure approach could be implemented in a coal pipeline by injecting $CO_2$ gas at various stations along the pipeline. Kinetics would not be a critical factor in this case except insofar as a quick establishment of near neutral conditions would minimize corrosion.

The results of direct comparison of various treatments are shown in Table 3, where low ratios of liquid-to-solid are utilized to compare de-ionized water, low $CO_2$ pressure, high $CO_2$ pressure, and 0.03N acetic acid after six days of contact.

TABLE 3

Comparison of Water and Weak Electrolytes in $Na^+$ and $Ca^{++}$ Exchange

| Liquid Solid Ratio | Reagent | % Stoichmetric Relative to $Na^+$ | % Reduction Na | % Reduction Ca | Selectivity % $Na^+$ Reduction / % $Ca^{++}$ Reduction |
|---|---|---|---|---|---|
| 2 | Water | 0% | 13 | 2.1 | 6.2 |
| 2 | Low Pressure $CO_2$ | N.D. | 27 | N.D. | — |
| 2 | High Pressure $CO_2$ | Large Excess | 40 | 3.3 | 12.1 |
| 1.5 | 0.03 N Acetic Acid | 65% | 22 | 4.3 | 5.1 |
| 2 | 0.03 N Acetic Acid | 87% | 27 | 4.9 | 5.5 |
| 3 | 0.03 N Acetic Acid | 130% | 35 | 7.9 | 4.4 |

Note: 6 days in contact with pH adjustment after 3 days in low $CO_2$ pressure case.

The high pressure $CO_2$ system in Table 3 shows two advantages over the other systems in this table. It shows the highest $Na^+$ reduction, and it shows the highest selectivity for $Na^+/Ca^{++}$. A material balance calculation suggested that the water phase in this experiment was 0.3 molar, i.e. 1.4%w in $CO_2$, or 2.8%w of $CO_2$ basis coal. This is higher than, for example, the weight ratio of acetic acid to coal in the 3 to 1 liquid-to-solid case. In this latter case the acetic acid is 0.54%w basis coal. The protonic content of the $CO_2$ system is 0.064%w basis coal (assuming first ionization step of carbonic acid) compared to 0.008% for the acetic acid.

In order to facilitate the analytical determinations in this work, we have made all of our exchange solutions using de-ionized water. In practice, a commercial process would preferably use an aquifer water, either as such, or after some minor adjustments.

Two types of cations are present in significant amounts in a typical aquifer: monovalent $Na^+$ and $K^+$ cations and divalent, $Ca^{++}$ and $Mg^{++}$ cations. The weight ratio of $(Ca^{++}+Mg^{++})/Na^+$ in the aquifer is generally greater than 1.0 and frequently ranges up to 3 or 4. In a few cases, however, sodium is the prevalent cation.

We have attempted to compare the performance of various treating systems in the context of a simulated process. The process concept considered involved two steps: 1 hour low pressure, open vessel mine-mouth contact at a 6/1 liquid/solid ratio, followed by a pipeline transport step at a 1.5/1 liquid/solid ratio, optionally at high pressure.

In this process −14 mesh size coal was first screened to yield a fraction of size large enough so that a coal/-water separation can be easily brought about after the first mine-mouth contacting step. The −14 mesh coal was separated with a 100 mesh screen, to yield a large particles fraction ranging from 150 microns to 1400 microns in size, and a small particles fraction with less than 100 micron size. The proportions were 74.2% larger than 100 mesh and 25.8% smaller than 100 mesh.

The larger fraction was treated in the 1-hour treatment steps and the solids were separated from the liquid. The entire sample was then treated for four days. In a commercial operation a 14-day contact time would yield higher $Na^+$ exchange. However, for comparative purposes the 4-day contact time may be more informative, in that rates tend to play a more important role than in a longer experiment.

The reagents for the open vessel, 1-hour treatment, were the following:

(A) De-ionized water
(B) De-ionized water/dry ice
(C) 0.01N acetic acid in de-ionized water In each treatment a 6/1 liquids/solids ratio was used. After one hour of contact the solids and liquids were separated and the pipeline transport experiment was done using either de-ionized water, or water/high pressure $CO_2$. In all of the experiments simulating pipeline conditions, a 1.5/1 liquid/solid ratio was used. The results of these experiments are summarized in Table 4.

TABLE 4

Cumulative % Removal of $Na^+$ Calculated on the Basis of Total Coal Sample
Condition: Step I: 1 hour, L/S ~6, 150–1400 micron
Step II: 4 days, L/S ~1.5, total-1400 micron sample (pipeline simulation)

| Case | Treatment | Removal |
|---|---|---|
| A | I: De-ioned Water (DIW) | 10.2 |
| | II: DIW | 16.5 |
| B | I: DIW | 10.2 |
| | II: DIW + High Pressure $CO_2$ | 36 |
| C | I: DIW + Dry Ice | 26 |
| | II: DIW | 28 |
| D | I: DIW + Dry Ice | 26 |
| | II: DIW + High Pressure $CO_2$ | 40 |
| E | I: 0.01 N Acetic Acid | 28.2 |

TABLE 4-continued

| Cumulative % Removal of $Na^+$ Calculated on the Basis of Total Coal Sample<br>Condition: Step I: 1 hour, L/S ~6, 150–1400 micron<br>Step II: 4 days, L/S ~1.5, total-1400 micron sample (pipeline simulation) | | |
|---|---|---|
| Case | Treatment | Removal |
| | II: DIW | 30 |
| F | I: 0.01 N Acetic Acid | 28.2 |
| | II: DIW + High Pressure $CO_2$ | 40 |

Review of the results in Table 4 shows that Case A, a de-ionized water only case, would yield a marginal removal of $Na^+$ of ~16–17. On the other hand, using 0.01N acetic acid in the first step and high $CO_2$ pressure in the second step yields 40% $Na^+$ removal.

In general, substantially any weak acid capable of yielding an aqueous solution having a pH of from about 3 to 6 can be utilized in the present process. Particularly suitable acids comprise carbonic acid (as an aqueous solution of $CO_2$ with or without pressurization) formic acid or acetic acid. In treatments of the type preferred for use with a mine site, the liquid/solid ratio should be about 3 to 9 parts of liquid per part of solid, and preferably, from about 5 to 7 parts of liquid per part of solid. In treatments suitable for being conducted while transporting coal by means of a pipeline, a liquid/solid ratio of about 1.3 to 2 parts per part of coal with the acid comprising carbonic acid formed by periodic injections of $CO_2$ into an aqueous slurry of coal within the pipeline is preferred. In general, the concentration of the weak electrolyte solution should be at least 0.001N, and preferably at least 0.005N.

In a preferred procedure coal ground to particles of less than about ¾" diameter is water-washed by a process involving immersing the coal in an aqueous liquid which is substantially free of sodium ions. The washed coal is mechanically separated from the liquid in at least two fractions. Fraction (A) comprises relatively large coal particles capable of being settled by gravity from the liquid in a feasibly short time. Fraction (B) comprises the particles which are too fine for such a desirably rapid mechanical separation. The particles of fraction (A) are separately ion-exchanged with an aqueous electrolyte, then mixed with an aqueous slurry of the particles of fraction (B). The resulting mixture is preferably subjected to an additional ion-exchange.

What is claimed is:

1. A process for upgrading coal comprising:

contacting coal with water having a relatively low concentration of ions, for dissolving water-soluble compounds containing sodium ions; and contacting the water-washed coal with an aqueous solution of a weak acid, selected from the group consisting of carbonic, formic and acetic acid, for ion-exchanging protons from the acid solution for sodium ions from the coal.

2. The process of claim 1 using a relatively high ratio of weak acid solution to coal solids of about 3 to 9 parts by weight of liquid per part by weight of coal.

3. The process of claim 2 in which the weak acid is carbonic acid formed by injection of $CO_2$ into an aqueous slurry of coal.

4. The process of claim 1 using a relatively low ratio of weak acid solution of about 1.3 to 2 parts by weight of the solution per part by weight of coal, and using a relatively long contact time between the coal and the weak acid solution.

5. The process of claim 4 in which the weak acid is carbonic acid formed by periodic injections of $CO_2$ into an aqueous slurry of coal in a pipeline.

* * * * *